US007642476B2

(12) United States Patent
Virtanen et al.

(10) Patent No.: US 7,642,476 B2
(45) Date of Patent: Jan. 5, 2010

(54) PUSH-BUTTON ARRANGEMENT AND PUSH-BUTTON

(75) Inventors: Isto Virtanen, Lempäälä (FI); Toni Karvonen, Tampere (FI); Eero Kumanto, Linnavuori (FI); Martti Muranen, Kangasala (FI)

(73) Assignee: Sandvik Mining and Construction Oy, Tampere (FI)

( * ) Notice: Subject to any disclaimer, the term of this patent is extended or adjusted under 35 U.S.C. 154(b) by 0 days.

(21) Appl. No.: 12/279,121

(22) PCT Filed: Feb. 13, 2007

(86) PCT No.: PCT/FI2007/050076

§ 371 (c)(1),
(2), (4) Date: Dec. 5, 2008

(87) PCT Pub. No.: WO2007/093673

PCT Pub. Date: Aug. 23, 2007

(65) Prior Publication Data

US 2009/0183975 A1 Jul. 23, 2009

(30) Foreign Application Priority Data

Feb. 14, 2006 (FI) ..... 20065111

(51) Int. Cl.
*H01H 13/06* (2006.01)

(52) U.S. Cl. ..... 200/302.1; 200/302.2

(58) Field of Classification Search ..... 200/302.1, 200/302.2, 302.3, 341; 277/347, 350, 351, 277/353, 624, 634–637, 641, 642, 644
See application file for complete search history.

(56) References Cited

U.S. PATENT DOCUMENTS

| | | | | |
|---|---|---|---|---|
| 3,236,990 | A | 2/1966 | Bates | |
| 3,372,246 | A | 3/1968 | Knuepfer | |
| 5,219,067 | A | 6/1993 | Lima et al. | |
| 5,271,293 | A * | 12/1993 | Olsson et al. | 74/553 |
| 5,413,358 | A * | 5/1995 | Austin et al. | 277/642 |
| 6,897,389 | B2 * | 5/2005 | Li | 200/341 |
| 7,230,196 | B2 * | 6/2007 | Toyama | 200/314 |
| 7,420,136 | B2 * | 9/2008 | Goetzl et al. | 200/341 |

FOREIGN PATENT DOCUMENTS

| | | |
|---|---|---|
| DE | 102 28 821 | 7/2003 |
| EP | 0 777 091 | 6/1997 |
| EP | 1 146 490 | 10/2001 |
| FR | 877 713 | 12/1942 |
| FR | 2 800 904 | 5/2001 |
| GB | 1 218 480 | 1/1971 |
| JP | 2003-178641 | 6/2003 |
| WO | 98/11577 | 3/1998 |

* cited by examiner

*Primary Examiner*—Michael A Friedhofer
(74) *Attorney, Agent, or Firm*—Drinker Biddle & Reath LLP

(57) ABSTRACT

A push-button arrangement and a push-button. The push-button comprises a fastening sleeve portion having a press portion at a first end thereof and a fastening member at a second end thereof for connecting the push-button to a fastening hole in a fastening plate. The outer surface of the fastening sleeve portion is provided with at least one conical sealing surface and the fastening hole, correspondingly, with a conical counter surface.

13 Claims, 2 Drawing Sheets

PUSH-BUTTON ARRANGEMENT AND PUSH-BUTTON

CROSS REFERENCE TO RELATED APPLICATIONS

This application is the National Stage of International Application No. PCT/FI2007/050076, filed Feb. 13, 2007, and claims benefit of Finnish Application No. 20065111, filed Feb. 14, 2006.

BACKGROUND OF THE INVENTION

The invention relates to a push-button arrangement comprising: at least one fastening plate having an outer surface and an inner surface; at least one fastening hole in the fastening plate; a switch arranged at the at least one fastening hole, on the inner surface side of the fastening plate; at least one push-button made substantially entirely of an elastic material; a fastening portion for fastening the push-button to the fastening hole in the fastening plate; and the fastening portion comprising at least one fastening sleeve portion with an annular cross-section and an outer surface arranged against the fastening hole; and the push-button comprising a press portion; and the fastening sleeve portion having at least one fastening member on the end portion facing away from the press portion, the fastening member being configured to press against the fastening plate.

The invention further relates to a push-button made substantially entirely of an elastic material and comprising: a fastening sleeve portion having a first end and a second end; a press portion arranged to close off the first end of the fastening sleeve portion; and a fastening member on the second end portion of the fastening sleeve portion.

Mobile machines, for example, are provided with control panels, control desks and similar control equipment that may include various control devices, such as control sticks, wheels, rolls and balls. The control equipment may further comprise push-buttons. A problem with current pushbuttons is that impurities and moisture may enter through the buttons inside the control equipment. Moreover, the impurities between a push-button and the housing of the control equipment may jam the button and prevent its operation. Although prior art knows buttons tightly enclosed under a protective film, finger contact with these buttons and their functionality is considered poor.

BRIEF DESCRIPTION OF THE INVENTION

It is an object of the invention to provide a novel and improved push-button arrangement and a push-button.

The push-button arrangement of the invention is characterized in that the fastening hole comprises at least one conical sealing surface; and that the outer surface of the fastening sleeve portion comprises at least one conical sealing surface arranged to press against the sealing surface of the fastening hole, thereby sealing the push-button and the fastening plate together.

The push-button of the invention is characterized in that the outer surface of the fastening sleeve portion comprises at least one conical sealing surface.

According to the invention the push-button comprises a fastening sleeve portion with a press portion on the first end thereof and a fastening member on the second end thereof. The outer surface of the fastening sleeve portion is provided with one or more conical sealing surfaces. Further, the fastening plate is provided with a fastening hole comprising one or more conical sealing surfaces. The sealing surface of the fastening sleeve portion is arranged to set against the sealing surface of the fastening hole.

An advantage of the invention is that the conical sealing surfaces between the fastening sleeve and the fastening hole are arranged to engage the push-button and the fastening plate together in a sealing manner, thereby preventing the access of impurities and moisture into the inner surface side of the fastening plate. Since this tight joint can be made without any separate seals or the like, the structure is simple and inexpensive to manufacture.

According to an embodiment of the invention the fastening hole comprises at least one conical sealing surface tapering from the outer surface of the fastening plate towards the inner surface thereof. The sealing surface of the fastening sleeve portion, which is arranged to set against the sealing surface of the fastening hole, is also conical and has an outer dimension that is greater closer to the outer surface end of the sleeve than the dimension closer to the inner surface end thereof. Because the sealing surfaces, when seen from the direction of the press surface, are conical surfaces tapering as described, the pressing of the press surface improves the sealing between the sealing surfaces. Moreover, sealing surfaces formed in this way contribute to keeping the push-button in place and also facilitate the installing of the push-button, because the button is inserted in place from the inner surface side of the fastening plate.

According to an embodiment of the invention the fastening sleeve portion and the fastening member are arranged so as to be substantially immobile in relation to the fastening plate. Consequently, when the push-button is pressed, only the press portion and an intermediary portion are arranged to move. An advantage of this embodiment is that there is a constant good sealing between the push-button and the fastening hole.

According to an embodiment of the invention the push-button comprises at least one intermediary portion on the inner surface side of the press portion. When the press portion is pressed, the intermediary portion may transmit the press force from the push-button to a switch. The intermediary portion may be part of the press portion, or it may be a separate piece.

According to an embodiment of the invention the push-button may be fastened to the fastening plate in a shape-locking manner.

According to an embodiment of the invention the fastening hole in the fastening plate is substantially circular. Further, the fastening sleeve portion comprises one or more portions with a substantially circular cross-section, the outer surface of the portion being arranged against the edges of the substantially circular fastening hole. Further, the press portion forms an end portion to the end of the fastening sleeve portion at the outer surface end of the push-button. Hence, the press portion, when seen from above, is a substantially circular portion. A circular cross-section is advantageous from the point of view of manufacturing and sealing properties.

According to an embodiment of the invention the fastening hole comprises at least two conical sealing surfaces substantially one after the other, when seen in the direction of thickness of the fastening plate. The fastening hole thus has at least an outer sealing surface and an inner sealing surface. Further, the fastening hole is provided with a shoulder between the outer sealing surface and the inner sealing surface. Correspondingly, the outer surface of the fastening sleeve portion is provided with at least two conical sealing surfaces for sealing the fastening sleeve portion against the sealing surfaces of the fastening hole. The fastening sleeve portion is also provided with a shoulder arranged to set against the shoulder of the fastening hole. Further still, the distance between a fastening flange of the push-button and the shoulder is dimensioned smaller than the distance between the shoulder of the fastening hole and the inner surface of the fastening plate, whereby the push-button is arranged to be provided with a fastening force which in turn is arranged to press the sealing surfaces of the push-button against the sealing surfaces of the fastening hole.

According to an embodiment of the invention, the push-button is a uniform piece made by moulding and therefore provides a sealed structure. In addition, this type of push-button is quick and easy to manufacture for example by injection moulding suitable elastic material. The material may be plastic, rubber or a combination of the two, for example.

According to an embodiment of the invention, the outer surface of the press portion is provided with at least one protrusion. The protrusion may be substantially in the middle of the press portion. The protrusion improves the finger contact with the button. Further, the protrusion may be shaped and coloured so as to indicate the purpose of use of the button. The protrusion may be provided with a symbol depicting the use.

According to an embodiment of the invention, the push-button is arranged in place into the fastening hole by inserting the button from the inner surface side of the fastening plate.

According to an embodiment of the invention, two or more buttons are interconnected by a common fastening flange. The fastening flange may be shaped as desired. In other words, this embodiment provides a mat-like keypad, which is quick and easy to fasten to the fastening plate.

According to an embodiment of the invention, the fastening plate is part of the control device of the machine. The fastening plate may be a cover panel of the control device and thereby partly define the component space accommodating switches and electrical components.

BRIEF DESCRIPTION OF THE FIGURES

In the following, some embodiments of the invention will be described in greater detail with reference to the accompanying drawings, in which.

For the sake of clarity, the embodiments shown in the Figures are simplified. Like parts are indicated with like reference numerals.

A DETAILED DISCLOSURE OF SOME OF THE EMBODIMENTS

Figure 1:
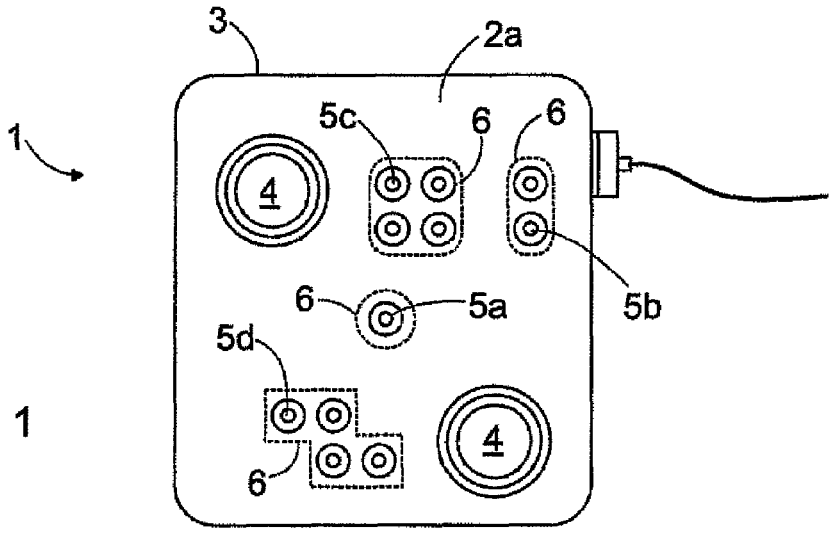
FIG. 1 is a schematic view, seen from above, of control equipment of a machine.

FIG. 1 shows control equipment 1 for controlling the operations of a machine at work. The machine in question may be for example a rock drilling rig, mining vehicle, excavator, forestry machine, hauling device, or the like. The control equipment 1 may be a box-type piece with a fastening plate 2 on the upper surface thereof. Underneath the fastening plate 2 there may be a component space 3 with the necessary switches and electrical components arranged therein. The fastening plate 2 may be provided with one or more control members, such as control sticks 4, wheels, rolls or balls arranged on the outer surface side thereof. In addition, the control equipment 1 may comprise one or more push-buttons 5. With the control members the machine operator may submit control commands to the control unit of the machine or directly to its actuators.

FIG. 1 shows different alternative push-buttons 5. The button may be an individual push-button 5*a*, a combination 5*b* of two buttons or a mat-like set 5*c* and 5*d* of several push-buttons. The push-buttons 5 may be arranged in various ways. The buttons 5 may be interconnected by a common fastening flange 6. The fastening flange 6 is a member which sets against the inner surface of the fastening flange 2 when an individual button 5*a* or a mat-like button set 5*b* to 5*d* is arranged in place. Instead of the fastening flange 6, the push-button may be provided with some other kind of fastening member.

Figure 2:
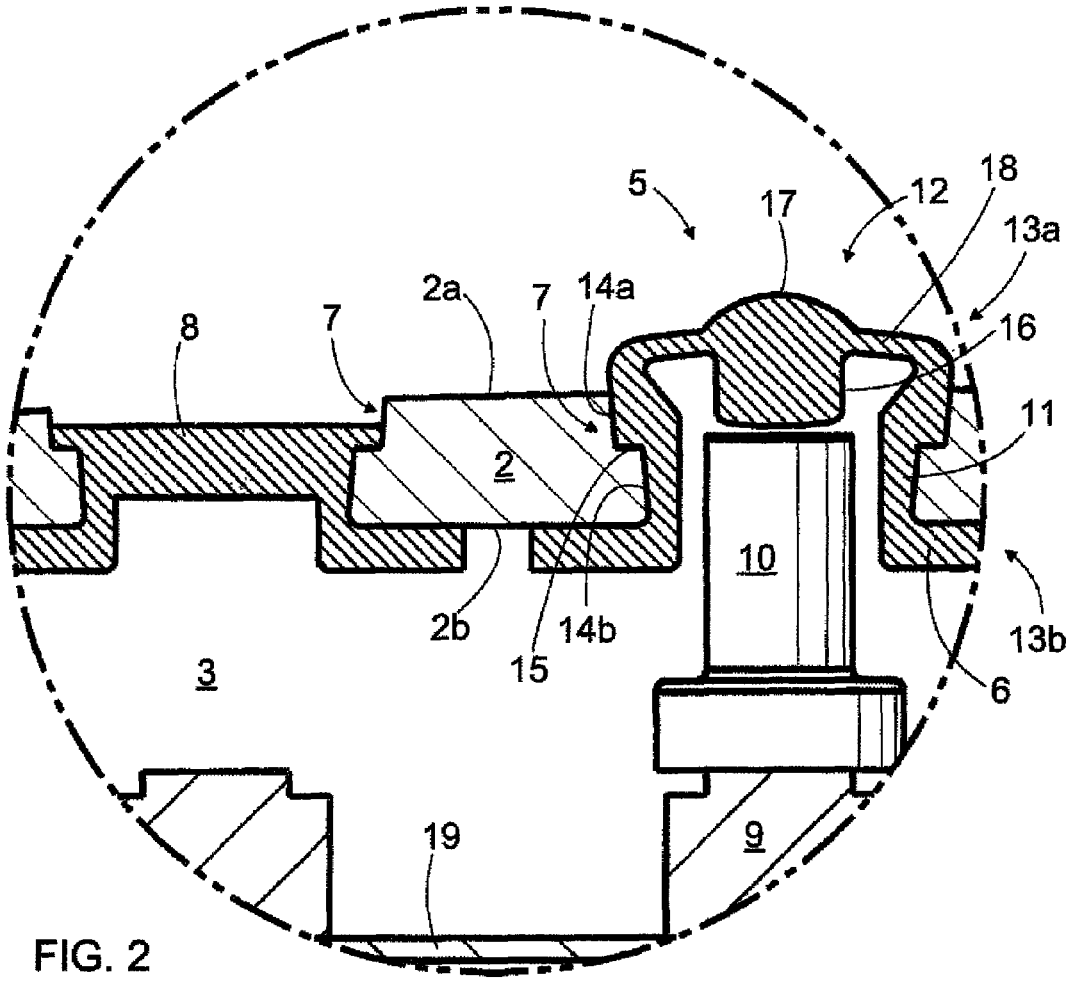
FIG. 2 is a schematic, sectional view of a push-button arrangement according to the invention.

FIG. 2 shows a detail of the control equipment 1. The fastening plate 2 comprises an outer surface 2*a* and an inner surface 2*b*. The inner surface 2*b* of the fastening plate may restrict the component space 3 of the control equipment 1. The fastening plate 2 is provided with one or more fastening holes 7 extending through the plate and meant for fastening the push-button 5. As seen in the Figure, the fastening plate may be provided with additional fastening holes for future needs and the holes may be closed by a plug 8.

The component space 3 may be provided with a switch 9 arranged at the fastening hole 7, the pressing of the switch being arranged to generate an electrical control signal. The switch 9 in the component space 3 may be fastened to a suitable fastening surface 19, such as the base plate of the control equipment 1 or a circuit board provided in the component space 3. The push-button 5 comprises a fastening sleeve portion 11 having a press portion 12 at a first, or distal, end 13*a* thereof, while a second, i.e. proximal, end 13*b* thereof may be provided with a fastening flange. The fastening hole 7, when seen in its longitudinal direction, may comprise one or more conical sealing surfaces. The solution of the figure is provided with two conical sealing surfaces, i.e. an outer first sealing surface and an inner second sealing surface. Between theses sealing surfaces there may be provided a shoulder. Further, the sealing surfaces of the sealing hole may be tapering when seen from the outer surface 2*a* side of the fastening plate. Further, the outer surface of the fastening sleeve portion 11 of the push-button 5 is provided with sealing surfaces 14*a*, 14*b* shaped correspondingly as those of the fastening hole 7. In addition, the outer surface of the fastening sleeve portion 7 is provided with a shoulder 15, which sets against the shoulder of the fastening hole 7. The shoulder 15 and the fastening flange 6 may keep the push-button 5 in place in the longitudinal direction of the fastening hole 7.

On the inner surface of the press portion 12 there may be an intermediary portion 16 that may be in the form of a protrusion. When the press portion 12 is pressed, the intermediary portion 16 transmits the movement to the switch 9. Since the fastening sleeve portion 11 has an annular cross-section, the intermediary portion 16 may move inside the fastening sleeve portion 11. Further, if the distance between the push-button 5 and the switch 9 is long, the intermediary portion 16 and the switch 9 may have at least a second intermediary portion 10 between them. The second intermediary portion 10 may be a separate piece.

The outer surface of the press portion 12 may be provided with a protrusion 17 to improve the finger contact. In general, finger contact can be influenced by the choice of the material of the push-button 5, the dimensioning of the wall thickness of the press portion 12 and the dimensioning and shape of the intermediary portion 16.

The push-button 5 may be a uniform piece that may be made of an elastic material by moulding, for example. The button 5 may be inserted in place into the fastening hole 7 from the inner surface side of the fastening plate 2. In this case the conical sealing surfaces press against each other and provide a sealing joint between the push-button 5 and the fastening plate 2. When the press portion 12 is pressed downward, the sealing surfaces of the push-button may press increasing tightly against the conical sealing surfaces of the fastening hole 7. Thus the pressing of the push-button 5 does not in any way impair its tightness. However, it is also possible that the press portion 12 comprises one or more thinned portions 18 at which the press portion 12 is allowed to bend when the push-button is pressed. Hence it is possible to avoid the press force from being transmitted to the fastening sleeve portion 11 and the fastening member.

The length of the fastening sleeve portion 11 may be dimensioned according to the thickness of the selected fastening plate 2. Further, the dimensions of the fastening hole 7 and the transverse dimensions of the push-button 5 may be selected as desired, taking into account aspects such as purpose of use, location of the push-button, the button force to be transmitted, frequency of use, significance of the push-button, user expectations and whether the push-button will be used with bare hands or with gloves on.

Unlike in FIGS. 1 and 2, the fastening hole 7 may comprise only one conical sealing surface, the fastening sleeve portion 11 of the push-button 5 being then correspondingly provided with one conical sealing surface. However, the fastening hole and, correspondingly, the fastening sleeve portion, may equally well be provided with more than two sealing surfaces. Further, it is also possible that the fastening hole 7 is provided with a conical sealing surface that is arranged to widen when seen from the outer surface side of the fastening plate 2. In this case the fastening sleeve portion 11 of the push-button 5 is provided with a conical sealing surface that is suitable against this sealing surface. Still further, it is possible to provide the fastening hole 7 and the fastening sleeve portion 11 with conical sealing surfaces opposite to each other, in which case at least one sealing surface pair is arranged to widen outward and at least one sealing surface pair is arranged to widen inward.

Figure 3:
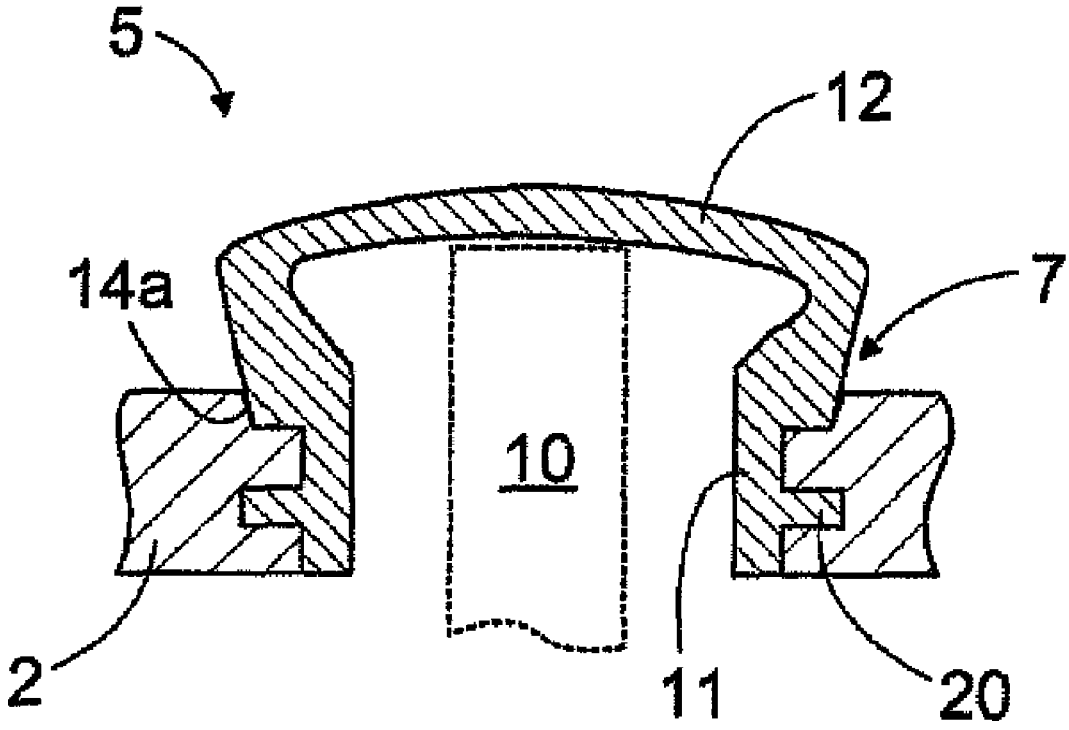
FIG. 3 is a schematic, sectional view of another push-button according to the invention.

FIG. 3 shows the push-button 5 and the fastening hole 7 of the fastening plate 2 in a sealing arrangement provided by means of one conical sealing surface 14*a*. The fastening sleeve portion 11 comprises a fastening protrusion 20 arranged into a groove in the fastening plate 2. Other alternative fastening members can also be used. The fastening does not necessarily have to be of the shape-locking type. Further, the inner surface side of the press portion 12 may be provided with an intermediary portion 10, shown with a broken line, which may transmit the press force to the switch.

In some cases the characteristics disclosed in this application may be applied as such, irrespective of the other features. Then again, the characteristics described herein may also be combined, when necessary, to provide different combinations.

The drawings and the related specification are only meant to illustrate the inventive idea. The details of the invention may vary within the scope of the claims.

The invention claimed is:

1. A push-button arrangement comprising:

at least one fastening plate having an outer surface and an inner surface;

at least one fastening hole in the fastening plate;

a switch arranged at the at least one fastening hole, on the inner surface side of the fastening plate;

at least one push-button made substantially entirely of an elastic material; and a fastening portion for fastening the push-button to the fastening hole in the fastening plate, the fastening portion comprising at least one fastening sleeve portion with an annular cross-section and an outer surface arranged against the fastening hole, the push-button comprising a press portion, the fastening sleeve portion having at least one fastening member on the end portion facing away from the press portion, the fastening member being configured to press against the fastening plate, the fastening hole comprising at least one conical sealing surface, the outer surface of the fastening sleeve portion comprising at least one conical sealing surface arranged to press against the sealing surface of the fastening hole, thereby providing a sealing arrangement between the push-button and the fastening plate, and the conical sealing surfaces of the fastening hole and the fastening sleeve portion tapering from the outer surface side towards the inner surface side, whereby the pressing of the push-button improves the sealing between the sealing surfaces.

2. A push-button arrangement according to claim 1, wherein the push-button comprises at least one intermediary portion on the inner surface side of the press portion, the intermediary portion being arranged to transmit the press force from the push-button to a switch when the press portion is pressed.

3. A push-button arrangement according to claim 1, wherein the fastening member is a fastening flange arranged to press against the inner surface of the fastening plate, and the fastening sleeve portion and the fastening flange are supported to be substantially immobile in relation to the fastening plate when the push-button is pressed.

4. A push-button arrangement according to claim 1, wherein the fastening hole comprises at least two conical sealing surfaces when seen in the direction of thickness of the fastening plate, namely an outer sealing surface and an inner sealing surface, both of which are arranged to taper from the outside inwards, the fastening hole is provided with a shoulder between the outer sealing surface and the inner sealing surface, the outer surface of the fastening sleeve portion is provided, correspondingly, with at least two conical sealing surfaces for sealing the fastening sleeve portion against the sealing surfaces of the fastening hole, the outer surface of the fastening sleeve portion is provided with a shoulder arranged to set against the shoulder of the fastening hole, and the distance between a fastening member of the push-button and the shoulder is dimensioned smaller than the distance between the shoulder of the fastening hole and the inner surface of the fastening plate, whereby the push-button is arranged to be provided with a fastening force which in turn is arranged to press the sealing surfaces of the push-button against the sealing surfaces of the fastening hole.

5. A push-button arrangement according to claim 1, wherein two or more buttons are provided with a common fastening flange arranged to interconnect the buttons into a uniform mat-like keypad.

6. A push-button, made substantially entirely of an elastic material and comprising:

a fastening sleeve portion having a first end and a second end a press portion arranged to close off the first end of the fastening sleeve portion; and a fastening member on the second end portion of the fastening sleeve portion, wherein the outer surface of the fastening sleeve portion comprises at least one conical sealing surface and wherein the outer surface of the fastening sleeve portion comprises at least one conical sealing surface at which the outer dimension closer to the second end of the fastening sleeve portion is smaller than the dimension closer to the first end.

7. A push-button according to claim 6, wherein the push-button comprises at least two conical sealing surfaces, namely a first conical sealing surface on the first end portion of the fastening sleeve portion and a second sealing surface on the second end portion of the fastening sleeve portion, the smallest outer dimension of the first sealing surface is greater than the smallest outer dimension of the second sealing surfaces, and the fastening sleeve portion is provided with a shoulder between the sealing surfaces.

8. A push-button according to claim 6, wherein at the interface between the press portion and the fastening sleeve portion there is provided at least one thinned portion, the press portion and the intermediary portion being arranged to move when push-button is pressed without substantially transmitting press force to the fastening sleeve portion.

9. A push-button according to claim 6, wherein the push-button is a uniform piece made by moulding.

10. A push-button according to claim 6, wherein the cross-section of the fastening sleeve portion is annular.

11. A push-button according to claim 6, wherein the press portion comprises an intermediary portion, which is a protrusion and arranged to extend from the press portion towards the second end of the fastening sleeve portion, the intermediary portion being arranged to move inside the fastening sleeve portion towards the second end, when the press portion is pressed.

12. A push-button according to claim 6, wherein the outer surface of the press portion is provided with at least one protrusion.

13. A push-button according to claim 6, wherein the fastening member is a fastening flange.

* * * * *